US006979190B2

(12) United States Patent
Ichikawa et al.

(10) Patent No.: US 6,979,190 B2
(45) Date of Patent: Dec. 27, 2005

(54) IGNITING OPERATION MECHANISM OF PIEZOELECTRIC IGNITION FIRING ROD

(75) Inventors: Toshihiro Ichikawa, Sunto-gun (JP); Youichi Ozawa, Sunto-gun (JP)

(73) Assignee: Tokai Corporation, Tokyo (JP)

( * ) Notice: Subject to any disclaimer, the term of this patent is extended or adjusted under 35 U.S.C. 154(b) by 220 days.

(21) Appl. No.: 10/089,200

(22) PCT Filed: May 30, 2001

(86) PCT No.: PCT/JP01/04531

§ 371 (c)(1),
(2), (4) Date: Apr. 3, 2003

(87) PCT Pub. No.: WO02/12794

PCT Pub. Date: Feb. 14, 2002

(65) Prior Publication Data

US 2004/0096791 A1 May 20, 2004

(30) Foreign Application Priority Data

Aug. 8, 2000 (JP) ..... 2000-239974

(51) Int. Cl.[7] ..... F23D 11/36

(52) U.S. Cl. ..... 431/153; 431/255

(58) Field of Search ..... 431/153, 255

(56) References Cited

U.S. PATENT DOCUMENTS

| | | | | |
|---|---|---|---|---|
| 3,817,691 | A * | 6/1974 | Tatsumi | 431/255 |
| 5,967,768 | A * | 10/1999 | Saito et al. | 431/153 |
| 5,971,751 | A | 10/1999 | Lee | |
| 6,540,506 | B1 * | 4/2003 | Li | 431/153 |
| 6,575,735 | B1 * | 6/2003 | Lloveras Capilla | 431/153 |
| 6,648,629 | B2 * | 11/2003 | Ichikawa et al. | 431/153 |

FOREIGN PATENT DOCUMENTS

JP 43066986 12/1999

* cited by examiner

*Primary Examiner*—Alfred Basichas
(74) *Attorney, Agent, or Firm*—Dellett and Walters

(57) ABSTRACT

The present invention provides an ignition actuation mechanism for the manual actuator of a spark producing device in a fuel gas lighter to increase the actuation force immediately before spark discharge without unreasonably increasing the actuation force at the initial stages of movement of the manual actuator to reduce that chances of inadvertent ignition by small children, but maintaining good operability for adult users. Movement of the manual actuator is always resisted by a first elastic member while a second elastic member is positioned to resist movement of the manual actuator at a maximum of 30N to 50N after 60% or more of the total movement of the manual actuator required to produce a spark has occurred. Preferably the second elastic member is one or more flexible fingers molded from polyacetal resin.

22 Claims, 7 Drawing Sheets

IGNITING OPERATION MECHANISM OF PIEZOELECTRIC IGNITION FIRING ROD

FIELD OF INVENTION

The present invention relates generally to a piezoelectric lighter, more specifically to an ignition mechanism for piezoelectric lighter with increased actuation load (resistance to actuation) for improving safety.

BACKGROUND OF THE INVENTION

There are conventional piezoelectric lighters as portable igniters. Such lighters each include a gas tank at one end of a relatively long body. A valve mechanism is provided at the top portion of the gas tank for opening or closing a gas path that extends from the valve mechanism towards a nozzle formed at the tip of the valve mechanism. Also, a piezoelectric mechanism is provided for generating discharge current in ganged relationship with a lever type manual actuation button operable from the exterior of the lighter. A lever mechanism is provided for opening the valve mechanism in connection with the current generation operation of the piezoelectric mechanism. Actuation of the actuation button opens the valve mechanism for opening the gas path to emit fuel gas from the nozzle. At the same time, the piezoelectric mechanism generates discharge current, which flows as a spark between a discharge terminal disposed near the nozzle and the nozzle tip for igniting the fuel gas emitting from the nozzle. Lighters also exist where a separate manual actuator is used to release fuel gas and then the actuation button is used to generate an ignition spark.

Commonly, a slidable actuation button is positioned at the tip portion of the piezoelectric mechanism so that when it is pushed in the longitudinal direction of the lighter, the piezoelectric mechanism is also pushed for simultaneous gas release and piezoelectric actuation. Also known is an actuation button for pushing in a direction at an angle with respect to the longitudinal direction of the lighter, with a link connecting motion of the actuation button to the piezoelectric mechanism.

The lighters described above can be in the form of cigarette lighters with nozzles adjacent the release valve or utility lighters where the nozzle tip is spaced from the valve to provide a flame at a distance from the user. Also, such lighters may include a power source and a spark coil circuit much like those used on modern kitchen gas stoves.

It is known in lighter with actuation buttons that as increased actuation load makes the lighter more difficult to inadvertently ignite by all users especially people too young to have knowledge of proper use and an appreciation of danger of the open flame such lighters produce. U.S. Pat. No. 5,971,751 discloses a piezoelectric ignition lighter including a coil spring and a resilient member serially arranged inside an actuation button. The ignition actuation mechanism is configured such that forces to resist actuation are generated by the coil spring until it is fully compressed. Thereafter, the compression of the resilient member abruptly provides actuation-resisting forces at a much higher spring rate so that much higher forces are required to continue to move the actuation mechanism. Adults feeling the abrupt change in spring rate are sometimes fooled into believing that the piezoelectric mechanism has been fully depressed, does not produce a spark and that therefore is defective. Also commercially available are lighters having heavier spring load than normal inside a piezoelectric mechanism, thereby increasing actuation load to such level that young users have difficulty in producing an ignition.

Just like cigarette lighters, utility lighters are safer if they are designed so that people without the mental capacity to appreciate the danger of an open flame have difficulty actuating them. The conventional technique of increasing the final actuation load used in the ignition actuation mechanism for piezoelectric ignition lighter could be applied to a utility lighter. However, the conventional ignition actuation mechanism for lighter is constructed to increase the actuation load at a uniform spring rate from an initial preload over the entire actuation stroke of the piezoelectric mechanism. In other words, the actuation Load is heavy from the initial stage of ignition operation, which is not easy to operate even for adult users. The same problem remains when the technique is applied to a utility lighter.

It is therefore an object of the present invention to provide an ignition actuation mechanisms for utility lighters capable of producing light actuation loads during the initial actuation stage and increasing the actuation load abruptly immediately before discharge. In this way, it is possible to restrict operation by children while providing easy operation by adult users.

DISCLOSURE OF THE INVENTION

The present utility lighter ignition actuation mechanism pushes the piezoelectric or other spark generating mechanism by movement of the actuation member in a predetermined direction to generating discharge current to produce a spark between discharge electrodes for igniting released fuel gas. Generally, the present invention features a smoothly increasing force rate with respect to actuation stroke acting as resistance to operation of the actuation member. In this arrangement, the actuation forces are small at the initial stages of ignition operation but increase in a way to discourage young users that do not have sufficient appreciation of the danger of an open flame, while Good operability is maintained for adult users.

The utility lighter may have a slidable actuation button as the actuation member assembled to a tip portion of a piezoelectric mechanism, but the present invention can be applied to an utility lighter having an actuation button operated at an angle with respect to the longitudinal direction of the utility lighter and coupled to a link or the like for operating the piezoelectric mechanism.

The point to increase the required actuation force is preferably after reaching 60% to 90% of the actuation stroke of the piezoelectric mechanism prior to generation of discharge current. Operability is adversely affected if the actuation forces are increased too early or abruptly in the stroke, or too late so that to get to the desired maximum force, the spring rate must be so steep that the user feels what appears to be a dead stop.

Preferably, the maximum actuation load is 30N to 50N. Difficulty of use for children may be increased if the actuation force is larger but too much more actuation force can prevent adults, such as elderly women, from being able to produce a flame.

A typical construction to increase the rate of increase of actuation at a point along the actuation stroke of the piezoelectric mechanism include provision of a resilient member at the lower portion of the actuation member so that the resilient member begins to be resiliently compressed at the desired point of the actuation stroke of the piezoelectric mechanism. A prior art preloaded spring in the piezoelectric mechanism provides the initial rate of increasing actuation forces required for operation of the actuation member during the early stages of the actuation stroke of the piezoelectric mechanism. However, at the desired point in the actuation stroke, the high spring rate of the resilient member adds to the spring rate of the piezoelectric mechanism to cause an abrupt change in the perceived resistance to the operation of the actuation member.

The resilient member may be an integral part of the actuation member or may be a torsion plate or torsion plates separated from the actuation member.

The torsion plate or plates must be made from durable material to withstand repeated use. Such durable torsion plate may be molded integrally with the actuation member using polyacetal resin.

The resilient member also may be made separately from the actuation member in the form of a torsion plate integrally formed with a holder member separated from the actuation member. The holder member and the torsion plate may be integrally molded from polyacetal resin. Also, a metal spring may be used as the torsion plate.

PREFERRED EMBODIMENTS OF THE INVENTION

Now, embodiments of the present invention will be described in detail by reference to accompanying drawings.

(First Embodiment)

Figure 1:
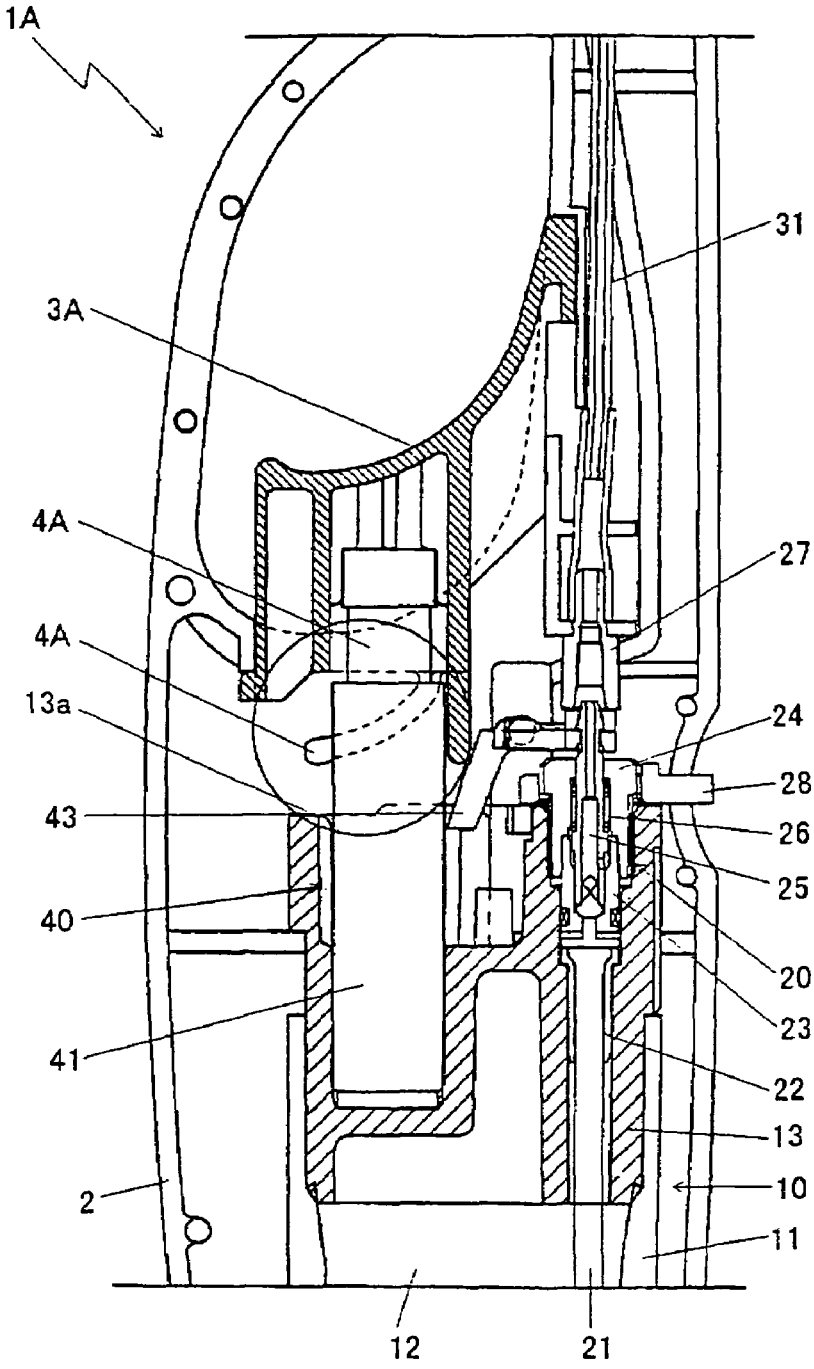
FIG. 1 is a center longitudinal cross section view of a first embodiment of an ignition mechanism of a utility lighter constructed according to the present invention.
Figure 2:
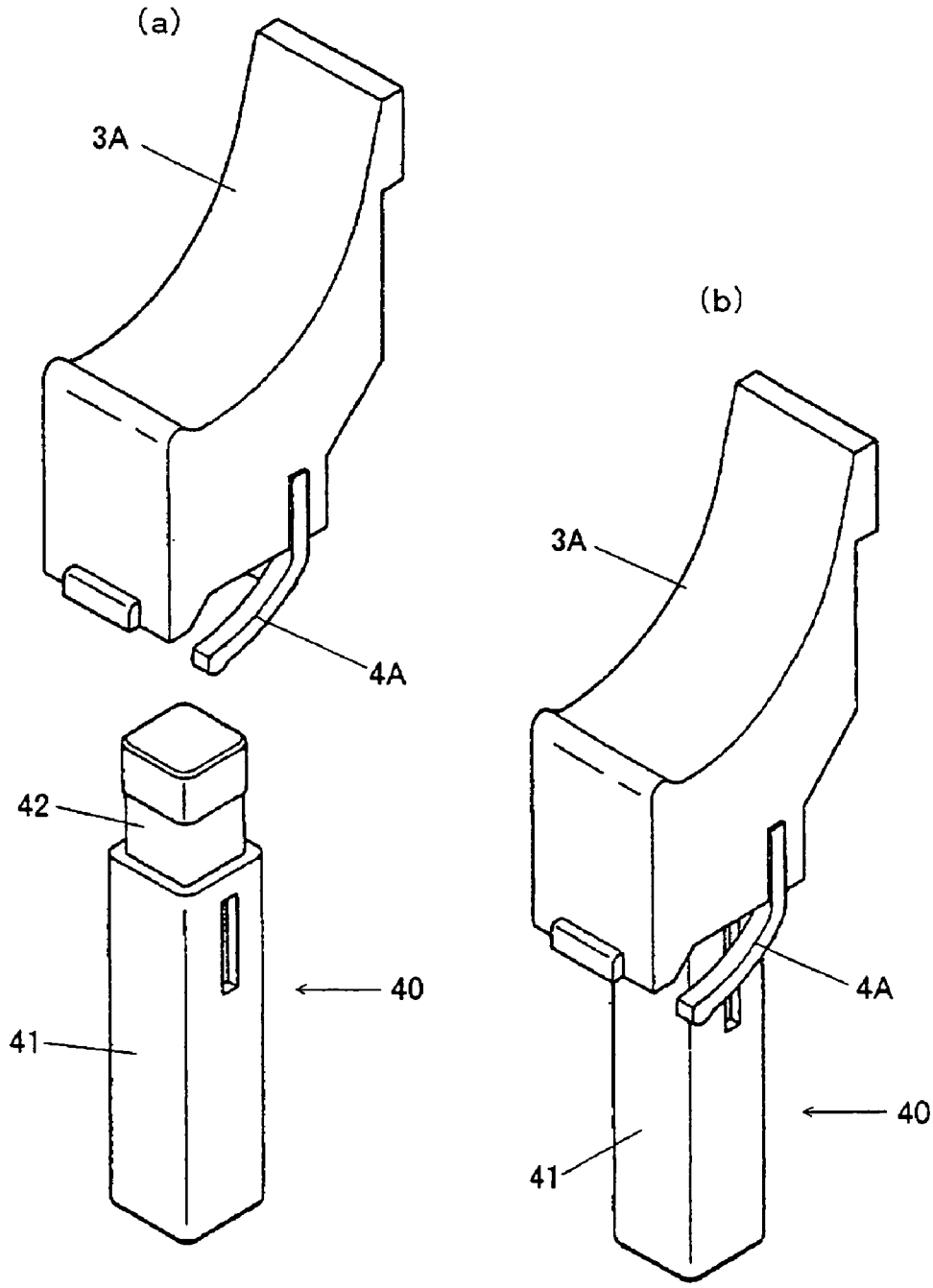
FIGS. 2(*a*) and 2(*b*) are perspective views of a dissembled and assembled actuation button/piezoelectric mechanism assembly for the ignition mechanism shown in FIG. 1.

The utility lighter 1A as illustrated in FIG. 1 includes a split shell-type body case 2. A cap and a bottom plate (not shown) are assembled respectively to the tip and bottom of the body case 2.

A gas tank 10 is disposed inside the body case 2 for storing fuel gas. The gas tank 10 comprises a tank body 11 made by molding synthetic resin, a tank chamber 12 having a valve mechanism 20 to be described hereinafter secured to the upper surface of the tank body 11 for storing fuel gas such as butane gas inside the tank body 11, and an upper lid 13 made from synthetic resin for holding a piezoelectric mechanism 40 to be described hereinafter.

Secured to the upper lid 13 of the tank body 11 is the valve mechanism 20 for opening and closing the gas path from the gas tank 10, thereby controlling when and the amount of fuel gas emitted.

The valve mechanism 20 is a conventional design. It comprises a nozzle bottom 23 including the gas path and a valve seat hermetically secured to sandwich a wick holder 22 for holding a wick 21 which transfers fuel gas in a liquid state from the gas tank 10 through an adjustment sleeve 24 installed at the top of the nozzle bottom 23 and to a nozzle member 25 extending through the adjustment sleeve 24.

The nozzle member 25 has a rubber lower end that contacts the valve seat of the nozzle bottom 23. The nozzle member 25 is biased towards the nozzle bottom 23 by a nozzle spring 26 disposed in the adjustment sleeve 24. The upper portion of the nozzle member 25 is inserted into and supported by a metal cylinder 27 secured to an isolation wall portion of the body case 2. The nozzle member's 25 lower end is normally biased to seat on the valve seat of the nozzle bottom 23 by the nozzle spring 26 to close the gas path.

The gas path opens when the nozzle member 25 is raised by a rotary lever 43 to be described hereinafter. A flame adjustment knob 28 is provided extending outwardly from a hole formed at the split of the body case 2 extending from a ring screwed to the tip periphery of the adjustment sleeve 24 for rotation to adjust the rate fuel gas is emitted.

Disposed at the nozzle holder portion inside the body case 2 at the end in the longitudinal direction is a nozzle (not shown) directed in the external direction. A vinyl hose 31 is disposed between the nozzle and the above mentioned metal cylinder 27.

Also secured to the upper lid 13 of the tank body 11 is a piezoelectric mechanism 40 conventionally constructed. The piezoelectric mechanism 40 includes an outer case 41 containing a piezoelectric element for generating high voltage pulse when a it is rapidly strained. An inner case 42 containing a hammer to rapidly apply force to the piezoelectric element is inserted into the outer case 41 in such a manner that the upper end portion extends outwardly. The inner case 42 is movable in the axial direction between an initial latched position where the hammer is opposed to the piezoelectric element at a certain distance and a position where the hammer hits the piezoelectric element. A return spring is provided inside the outer case 41 for urging the outer case 41 away from the inner case 42 so that the distance between the piezoelectric element and the hammer is reset after an actuation. A hammer spring is disposed inside the inner case 42 for pushing up the hammer against the piezoelectric element. A sliding actuation button 3A forming an actuation member for ignition operation is assembled at the end portion of the piezoelectric mechanism 40. The sliding actuation button 3A is operable from outside of the body case 2.

The actuation button 3A is made from polyacetal resin and is molded in a shape for digital engagement. Integrally formed with the actuation button 3A at the bottom portion thereof are a pair of cantilevered leaf springs 4A, 4A so that they face the upper end surface 13*a* of the upper lid 13 of the gas tank 10 at the both sides of the piezoelectric mechanism 40 after assembly.

Upon depressing the actuation button 3A by a finger, the piezoelectric mechanism 40 of the utility lighter 1A is pushed down, thereby pushing a gas lever 43 by an extended portion at the lower end of the sliding portion of the actuation button 3A. Then, the gas lever 43 pivots to raise the nozzle member 25. This results in opening the valve mechanism 20 for supplying the fuel gas to the nozzle through the vinyl hose 31 for emission of the fuel gas. When the piezoelectric mechanism 40 is pushed to a predetermined position, a voltage is generated which causes a spark to jump between a discharge electrode of a cap (not shown) and the nozzle for igniting the emitting gas.

Figure 3:
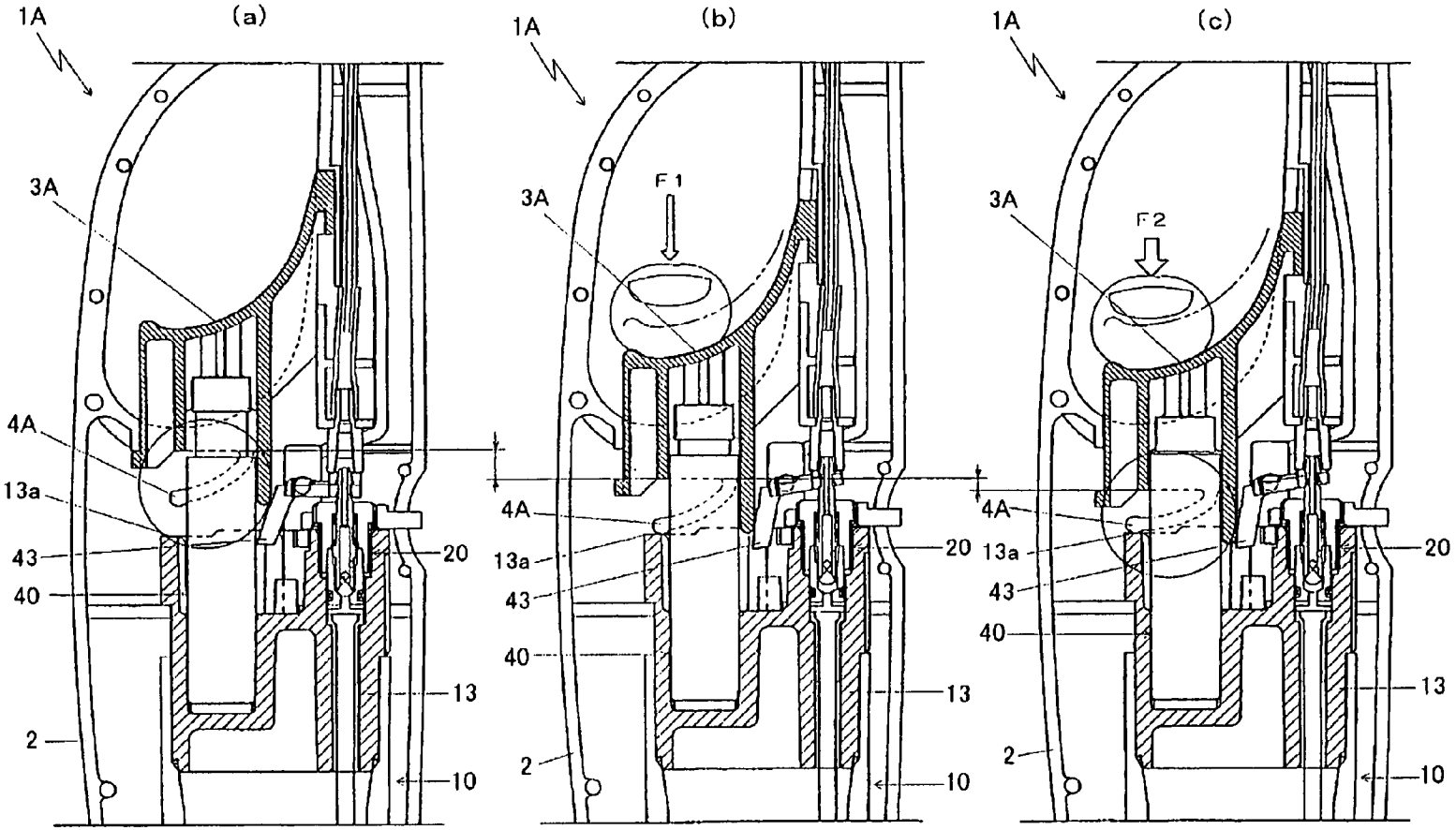
FIGS. 3(*a*), 3(*b*) and 3(*c*) are center longitudinal cross-section views for showing the operation of the ignition mechanism of the utility lighter of FIG. 1.

In a non-actuated condition as shown in FIG. 1 and FIG. 3(*a*), the springs 4A, 4A integral with the actuation button 3A are separated from the upper end surface 13*a* of the upper lid 13 of the gas tank 10 by a predetermined gap (e.g., 3.4 mm). The gap is set to about 60~90% of the actuation stroke (e.g., 4.5 mm) of the actuation button 3.

The ignition operation of the piezoelectric utility lighter 1A is performed by depression of the actuation button 3A. That is, when the actuation button 3A is depressed, the inner case 42 of the piezoelectric mechanism 40 is pushed down and thus pivoting the gas lever 43. Then the nozzle member 25 is raised to open the valve mechanism 20 for emission of the fuel gas. When the actuation button 3A is fully depressed, the latch mechanism inside the piezoelectric mechanism 40 is released to hardly hit the piezoelectric element by the hammer and thus the discharge voltage (high voltage pulse) is generated to cause a spark to jump between the discharge electrodes for igniting the fuel gas.

The ignition operation by depressing the actuation button 3A is performed against spring force of the return spring inside the piezoelectric mechanism 40 and to a lesser extent the spring of the nozzle. The spring load of the return spring is the actuation load at the initial stage of ignition operation. When the actuation button 3A is depressed to, e.g., 3.4 mm, the springs 4A, 4A abut against the upper end surface 13*a* of the upper lid 13 as illustrated in FIG. 3(*c*). Thereafter, the springs 4A, 4A are bent as illustrated in FIG. 3(*c*) to increase the actuation load by adding in parallel the resilient load of the springs 4A, 4A to the spring load of the return spring thereby increasing the rate of resistance to the actuation operation.

Figure 4:
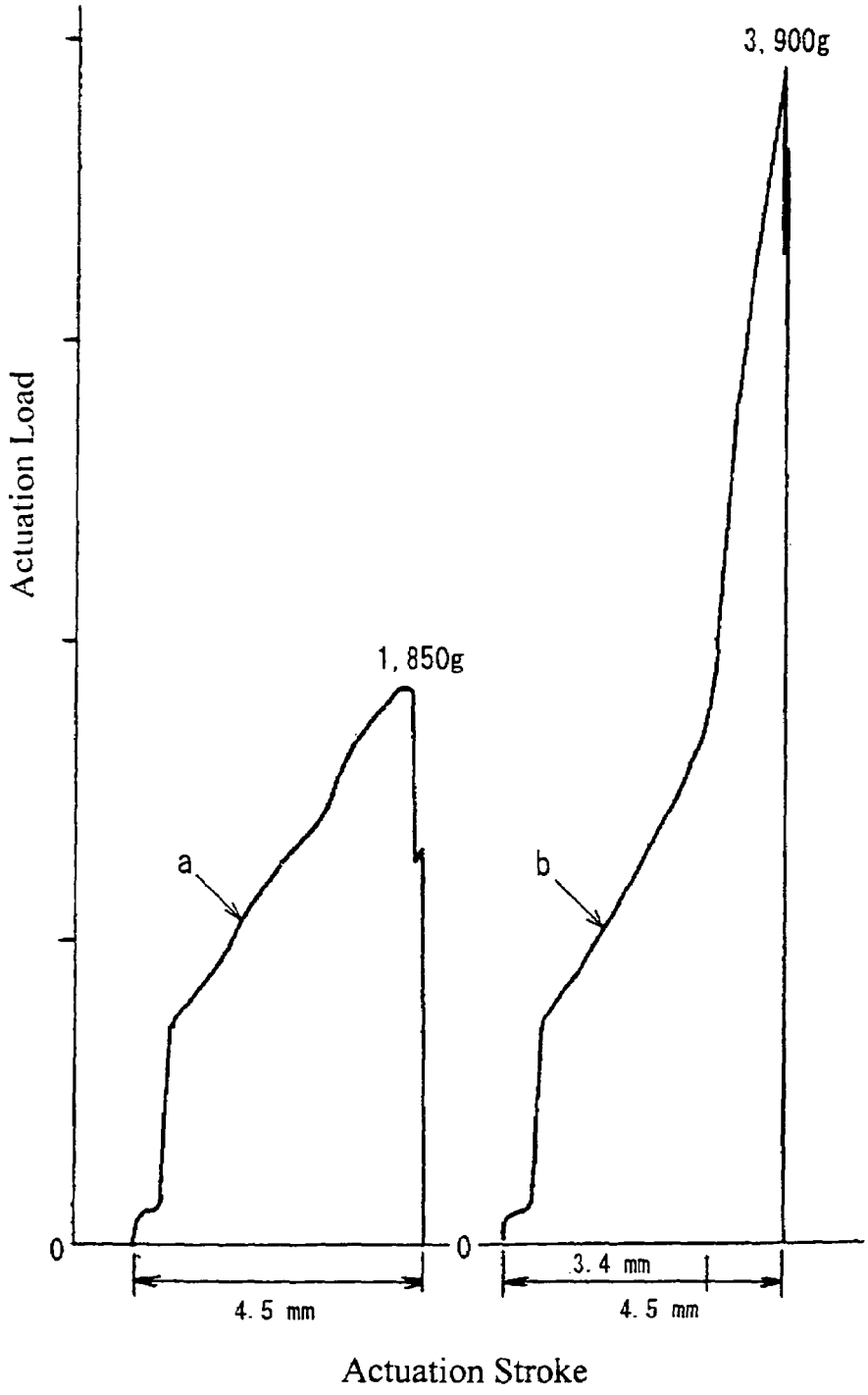
FIG. 4 is a graph showing the relationship between actuation stroke and actuation force of the present invention and a similar prior art utility lighter.

In this case, the relationship between the actuation stroke of the actuation button 3A (equal to the actuation stroke up to generation of the discharge voltage due to depression of the piezoelectric mechanism 40) and the actuation load rate, e.g., as shown by the graph b in FIG. 4 sharply increases at the position (e.g., 3.4 mm) where the springs 4A, 4A abut against the upper end surface 13*a* of the upper lid 13. The actuation load reaches about 40N (3,900 grams) immediately before ignition. On the other hand, the graph a in FIG. 4 is the actuation load over the entire actuation stroke primarily by the spring load inside the piezoelectric mechanism 40 and excluding the torsion plates 4A, 4A. The maximum actuation load reaches the maximum value of, e.g., about 19N (1,850 grams) in this case.

As apparent from the above description, the actuation load of the actuation button 3A sharply increases in rate with respect to actuation stroke (the actuation stroke of the piezoelectric mechanism 40) to ultimately reach about 40N that is too heavy for most young children to operate. Since the actuation load does not increase until last 40~10% of the actuation stroke before generation of the spark, the initial actuation load is light and is not difficult to overcome by normal users.

Preferably, the maximum actuation load is 30N~50N in consideration of safety and operability.

(Second Embodiment)

The second embodiment is the use of leaf springs separated from the actuation button as the resilient member for increasing the actuation load of the ignition operation in the way of the actuation stroke. The construction and operation of the other portions of the piezoelectric utility lighter are basically the same as those of the first embodiment. Accordingly, portions corresponding to those of the first embodiment have the same reference numerals. The following description of the second embodiment is directed to construction and operation unique to the second embodiment.

The piezoelectric utility lighter 1B of the second embodiment has a finger receiving actuation button 3B assembled to the end portion of the piezoelectric mechanism 40 capable of actuation from outside along the longitudinal direction of the body case 2 as the actuation member for ignition operation.

Figure 5:
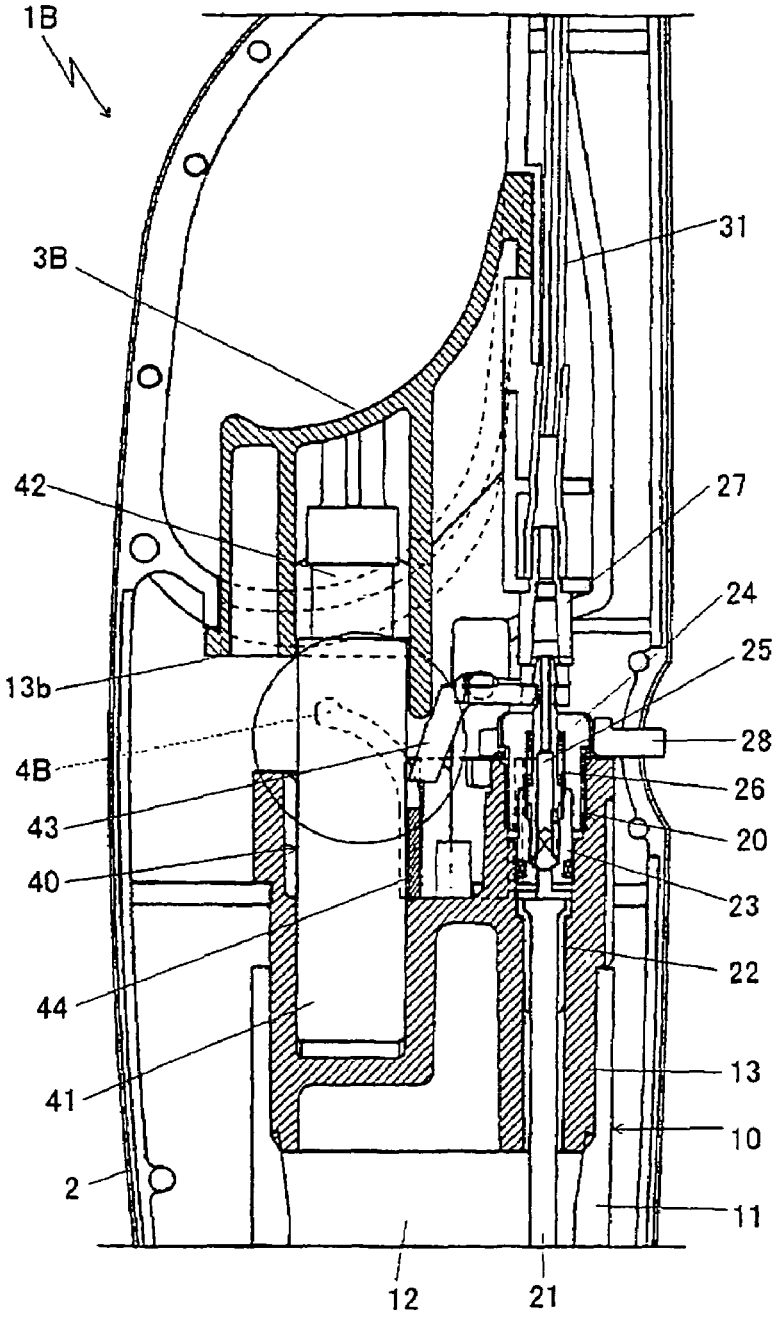
FIG. 5 is a center longitudinal cross section view of a second embodiment of the present invention.
Figure 6:
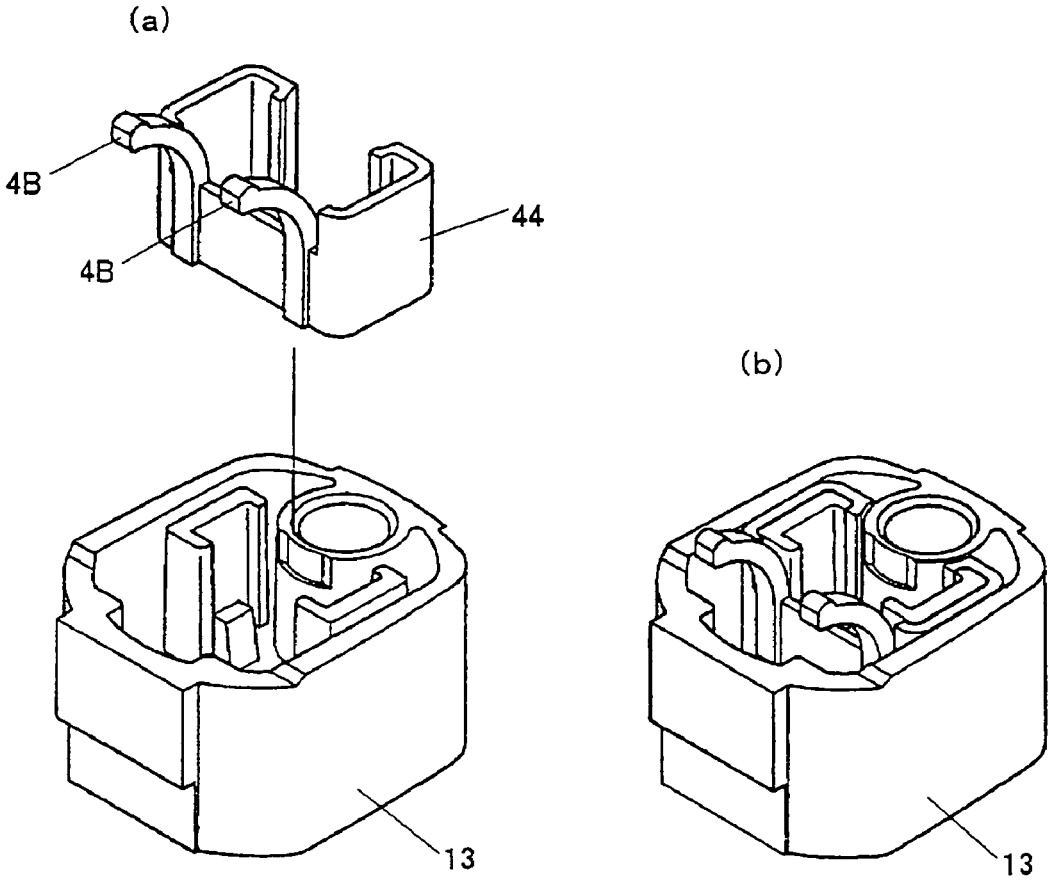
FIGS. 6(*a*), and 6(*b*) are perspective views before assembly and after assembly of the torsion plate/body upper cap assembly of the second embodiment of the present invention.
Figure 7:
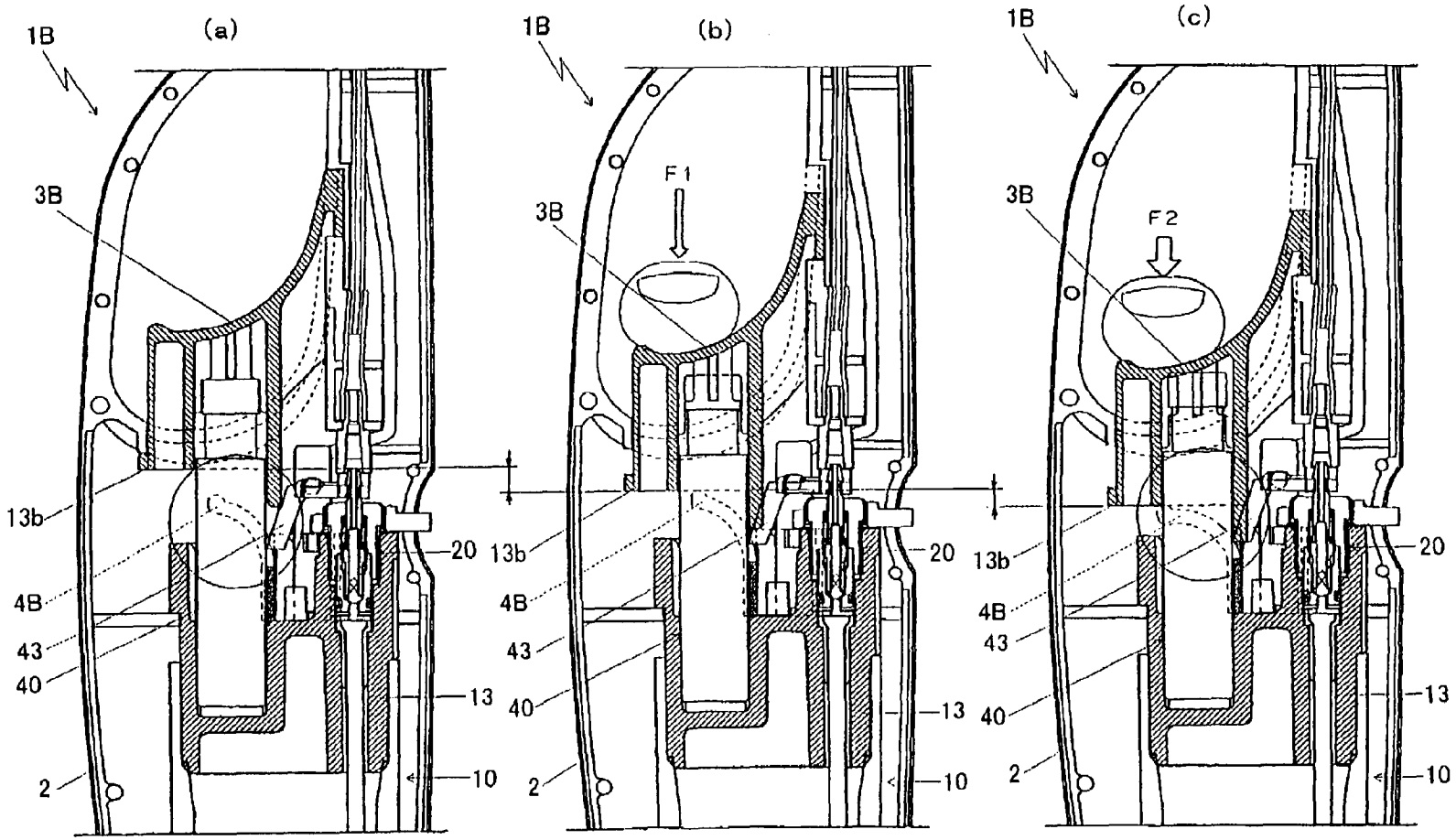
FIGS. 7(*a*), 7(*b*), and 7(*c*) are center longitudinal cross section views showing the ignition operation of the second embodiment of the present invention.

In order to increase the actuation load rate for ignition operation required to depress the actuation button 3B for the actuation stroke, springs 4B, 4B are integrally molded with a holder member 44 using polyacetal resin. When the holder member 44 is assembled with the upper lid 13, the springs 4B, 4B are separated from the lower end surface 13*b* of the actuation button 3B by a predetermined gap (e.g., 3.4 mm) under non-actuated condition as illustrated in FIG. 5 and FIG. 7(*a*)

The piezoelectric utility lighter 1B is also designed to ignite by depressing the actuation button 3B. At the initial ignition operation, the actuation load rate is provided primarily by the spring load of the return spring. However, when the actuation button 3B is depressed to, e.g., 3.4 mm, the springs 4B, 4B abut against the lower end surface 13*b* of the actuation button 3B as illustrated in FIG. 7 (*b*). During the subsequent stroke, the springs 4B, 4B bend to increase the actuation load rate of the actuation operation by adding in parallel the resilient load rate of the springs 4B, 4B to the spring load rate of the return spring thereby abruptly increasing the rate. This increase in spring rate causes a child, who might otherwise have enough strength to cause an actuation, to believe that the end of travel of the actuator button has been reached, discouraging attempts at further movement.

The relationship between the actuation stroke of the actuation button 3B and the instantaneous actuation load in this embodiment is the same as the first embodiment and sharply increases in the way of the actuation stroke, e.g., as shown by the graph b in FIG. 4. The final actuation load reaches about 40N so that any person who has no knowledge of proper use is not likely to operate the utility lighter. Since the initial actuation is light, it is not difficult to use for normal users. It is preferable in this embodiment that the maximum actuation load is 30N~50N in consideration of safety and operability.

Although the actuation button 3A and the torsion plates 4A, 4A are integrally molded using polyacetal resin in the first embodiment and the holder member 44 and the torsion plates 4B, 4B are integrally molded using polyacetal resin in the second embodiment, the resin may be replaced by any other durable material suitable for repeated use. Also, the torsion plates may be made from metal springs assembled with the actuation button or the holder member or implanted in the molding step. It is also possible that the torsion plates and the holder member may be integrally made from suitable metal.

Although the above embodiments are directed to piezoelectric utility lighters provided with vertically slidable actuation button, the present invention may be applied to any piezoelectric utility lighter provided with the actuation button depressed at an angle with respect to the longitudinal direction.

INDUSTRIAL APPLICABILITY

Since the actuation load rate of the piezoelectric utility lighter constructed according to the present invention sharply increases during the actuation stroke of the piezoelectric mechanism, the actuation load is light at the initial ignition stage and increases in the way of the actuation stroke. This arrangement is effective to prevent inadvertent ignition by children having insufficient knowledge of proper lighter use and prevent undesirable ignition without degrading operability for adult users. As a result, it maintains safety and good operability and also improves market value.

In construction, it simply utilizes resilient member such as leaf springs in the form of resilient fingers which can be positioned in small spaces about the piezoelectric mechanism. In case of utilizing cantilevered leaf springs, they can be formed integrally with the actuation button or the like, thereby eliminating any requirement for additional parts and allowing low production cost.

What is claimed is:

1. An ignition actuation mechanism for a lighter for generating discharge voltage that causes a spark of electrical current between ignition electrodes to ignite fuel gas when an actuation member is pressed including:

a first elastic member positioned to resist actuation movement of the actuation member having:

a first spring rate; and a second elastic member positioned in parallel with said first elastic member to resist actuation movement of the actuation member having:

a second spring rate higher than said first spring rate, said second elastic member being positioned for engagement to resist actuation movement of the actuation member only after more than half of the actuation movement of said first elastic member, whereby the effective spring rate to resist pressing movement of the actuation member sharply increases during the ignition actuation.

2. The spark ignition actuation mechanism as defined in claim 1, wherein said actuation member comprises a unitary surface adapted for digital engagement by a user for pressing actuation.

3. The ignition actuation mechanism as defined in claim 1 including:

a piezoelectric mechanism for generating the discharge voltage having:

an actuation end; and the actuation member, said actuation member being slidably mounted to operate said actuation end.

4. The ignition actuation mechanism as defined in claim 3 wherein said second elastic member includes:

torsion plates integrally formed with said actuation member.

5. The ignition actuation mechanism as defined in claim 1 wherein said second elastic member engages to resist actuation movement of the actuation member when 40% to 10% of the actuation movement remains.

6. The ignition actuation mechanism as defined in claim 5 wherein the maximum force to resist the actuation operation caused by the combined first and second spring rates is 30N to 50N.

7. The ignition actuation mechanism as defined in claim 3 wherein said second elastic member engages to resist actuation movement of the actuation member when 40% to 10% of the actuation movement remains.

8. The ignition actuation mechanism as defined in claim 7 wherein the maximum force to resist the actuation operation caused by the combined first and second spring rates is 30N to 50N.

9. The ignition actuation mechanism as defined in claim 8 wherein said actuation member and said torsion plates are integrally molded from polyacetal resin.

10. The ignition actuation mechanism as defined in claim 3 wherein said second elastic member includes:

torsion plates acting on said actuation member.

11. The ignition actuation mechanism as defined in claim 10 further including:

a holder member integrally formed with said second elastic member and positioned separate from said actuation member during an early portion of the actuation movement of said actuation member.

12. The ignition actuation mechanism as defined in claim 11 wherein said holder member and said torsion plates are integrally molded together from polyacetal resin.

13. A spark ignition actuation mechanism for a lighter to ignite fuel gas when an actuation member is pressed including:

a first elastic member positioned to resist pressing movement of the actuation member having:

a first spring rate; and a second elastic member positioned to act in parallel with said first elastic member to resist pressing movement of the actuation member having:

a second spring rate higher than said first spring rate, said second elastic member being positioned for engagement to resist pressing movement of the actuation member after a first portion of the pressing movement has occurred, whereby the effective spring rate to resist pressing movement of the actuation member increases sharply during a second later portion of the pressing movement, wherein said second elastic member is at least one flexible finger integrally formed with said actuation member.

14. The spark ignition actuation mechanism as defined in claim 13 wherein said actuation member and said at least one flexible finger are integrally molded from polyacetal resin.

15. A spark ignition actuation mechanism for a lighter to ignite fuel gas when an actuation member is pressed including:

a first elastic member positioned to resist pressing movement of the actuation member having:

a first spring rate; and a second elastic member positioned to act in parallel with said first elastic member to resist pressing movement of the actuation member having:

a second spring rate higher than said first spring rate, said second elastic member being positioned for engagement to resist pressing movement of the actuation member after a first portion of the pressing movement has occurred, whereby the effective spring rate to resist pressing movement of the actuation member increases sharply during a second later portion of the pressing movement, wherein said second elastic member is at least one flexible finger positioned for acting on said actuation member.

16. The spark ignition actuation mechanism as defined in claim 15 further including:

a holder member integrally formed with said second elastic member and positioned separate from said actuation member during an early portion of the actuation movement of said actuation member, wherein said holder member and said at least one flexible finger are integrally molded together from polyacetal resin.

17. A spark ignition actuation mechanism for a lighter to ignite fuel gas when an actuation member is pressed including:

a first elastic member positioned to resist pressing movement of the actuation member having:

a first spring rate; and a second elastic member positioned to act in parallel with said first elastic member to resist pressing movement of the actuation member having:

a second spring rate higher than said first spring rate, said second elastic member being positioned for engagement to resist pressing movement of the actuation member after a first portion of the pressing movement has occurred, whereby the effective spring rate to resist pressing movement of the actuation member increases sharply during a second later portion of the pressing movement.

18. The spark ignition actuation mechanism as defined in claim 17, wherein said actuation member comprises a unitary surface adapted for digital engagement by a user for pressing actuation.

19. The spark ignition actuation mechanism as defined in claim 20 wherein said first elastic member is positioned as part of said piezoelectric mechanism.

20. The spark ignition actuation mechanism as defined in claim 17 including:

a piezoelectric mechanism for generating the spark having:

an actuation end; and the actuation member, said actuation member being slidably mounted to operate said actuation end.

21. The spark ignition actuation mechanism as defined in claim 20 wherein said second elastic member engages to resist actuation movement of the actuation member when 40% to 10% of the actuation movement remains.

22. The spark ignition actuation mechanism as defined in claim 20 wherein the maximum force to resist the actuation operation caused by the combined first and second spring rates is 30N to 50N.

* * * * *